US005664816A

United States Patent [19]

Nigro, Jr. et al.

[11] Patent Number: 5,664,816

[45] Date of Patent: Sep. 9, 1997

[54] LEVER HANDLE ASSEMBLY WITH FIELD ADJUSTABLE TAILPIECE AND LEVER HANDING

[75] Inventors: Daniel N. Nigro, Jr.; Theodore J. Fritsch, both of Indianapolis, Ind.

[73] Assignee: Von Duprin, Inc., Indianapolis, Ind.

[21] Appl. No.: 523,712

[22] Filed: Sep. 5, 1995

[51] Int. Cl.[6] ..... E05B 3/00

[52] U.S. Cl. ..... 292/336.3; 70/422; 70/461; 292/165

[58] Field of Search ..... 70/422, 461; 292/336.3, 292/165

[56] References Cited

U.S. PATENT DOCUMENTS

| | | | |
|---|---|---|---|
| 2,222,411 | 11/1940 | Kaiser | 292/165 |
| 4,934,800 | 6/1990 | Choi | 292/336.3 X |
| 5,445,423 | 8/1995 | Mader | 292/336.3 |
| 5,484,179 | 1/1996 | Mader | 292/336.3 |

*Primary Examiner*—Allan D. Herrmann
*Attorney, Agent, or Firm*—Robert F. Palermo

[57] ABSTRACT

A door lever assembly has capability for changing the handing of the lever during installation. It includes a housing having a face with a bore for receiving a lever shaft and an input cam rotatably mounted in the housing. The input cam has a shaft for transmitting rotary motion to a latch spindle and a lever arm for rotatably driving the input cam and the shaft. A slider plate surrounds the shaft and the lever arm of the input cam and has a branched slot for permitting the slider to move relative to the shaft while driving the lever arm. A cover plate protects and retains all parts within the housing. Provision for removably mounting a cam on the lever shaft to be driven thereby against the slider plate, moving the slider plate to drive the lever arm of the input cam and to thereby rotate the shaft of the input cam to drive the latch spindle. A tailpiece, adjustable to indexed lengths, drivably connects the input cam and the latch spindle. A torque limiting and damage prevention feature is also included.

12 Claims, 2 Drawing Sheets

LEVER HANDLE ASSEMBLY WITH FIELD ADJUSTABLE TAILPIECE AND LEVER HANDING

CROSS REFERENCE TO RELATED APPLICATIONS

This application is related to U.S. patent application, Ser. No. 08/523,714, filed on Sep. 5, 1995 under Docket Number 2511-SL-VD by the inventors herein and assigned to the assignee of the present invention.

BACKGROUND OF THE INVENTION

This invention relates generally to door lever assemblies for use with panic exit devices and more particularly to door lever assemblies which are field adjustable during installation for handing and for door thickness.

Currently available door lever assemblies, especially those with internal locking, do not allow for easy installation, repair, or modification on site. Thus, if a different lever handle is desired, or if it is necessary to change handles or other parts because of damage due to vandalism or even routine wear and tear; it is often necessary to disassemble the whole lever assembly in order to install the new parts. This multiplies the risk of losing parts and/or incorrectly assembling them, both cases resulting in malfunctioning of the assembly. If lever handing is wrong, it may be necessary to replace some asymmetric components which are needed for operation of the assembly but which will not work when handing is reversed. This may be so even if such parts are neither worn nor damaged. If the door thickness is not as expected, it is necessary to either get a longer tailpiece to extend between the input cam and the latch spindle for a thicker door or to cut or break sufficient material off the tailpiece to make it the proper length for a thinner door.

The foregoing illustrates limitations known to exist in present door lever assemblies, and it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a door lever assembly is provided which has the capability for changing the handing of the lever during installation and includes a housing having a face with a bore for receiving a lever shaft; an input cam rotatably mounted in the housing, the input cam having a shaft with means for transmitting rotary motion to a latch spindle and a lever arm for rotatably driving the input cam and the shaft; a slider surrounding the shaft and the lever arm of the input cam and having a branched slot for permitting the slider to move relative to the shaft while driving the lever arm; means for removably mounting a cam on the lever shaft to be driven thereby against a surface of the slider plate, the cam moving the slider plate when the lever shaft is rotated to drive the lever arm of the input cam and to thereby rotate the shaft of the input cam.

The foregoing and other aspects of the invention will become apparent from the following detailed description, when considered in conjunction with the accompanying drawings.

DETAILED DESCRIPTION

Figure 1:
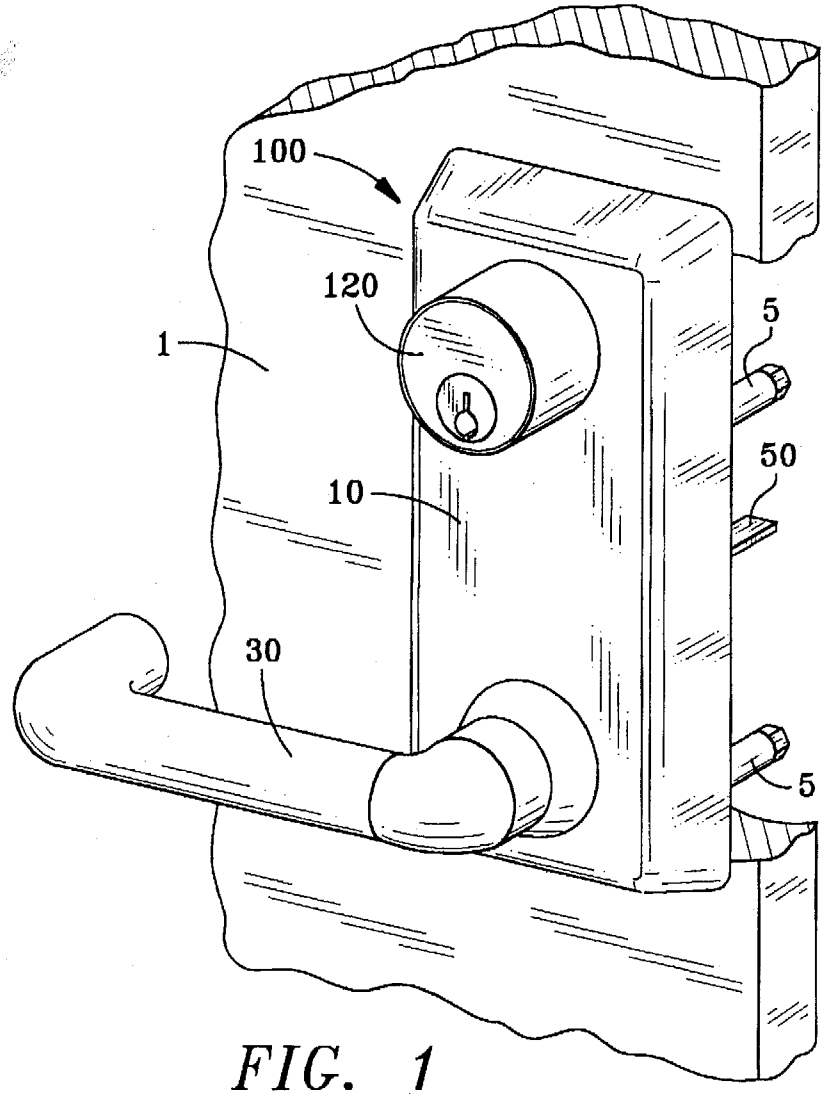
FIG. 1 is a schematic front perspective view illustrating a door lever handle assembly.

FIG. 1 is presented to show the environment of the invention. A door lever assembly 100 has a housing 10, a lock 120, and a lever 30 and is mounted on a door 1 shown broken away in the Figure. In this view, mounting studs 5 and tailpiece 50 are seen extending rearwardly from the back of the housing. This type of lever assembly is usually used with panic exit devices opposite the push bar.

The invention is best described by reference to FIGS. 2, 3, and 4; because not all features are visible in all figures and, for the sake of clarity, not every feature is numbered in every figure.

Figure 2:
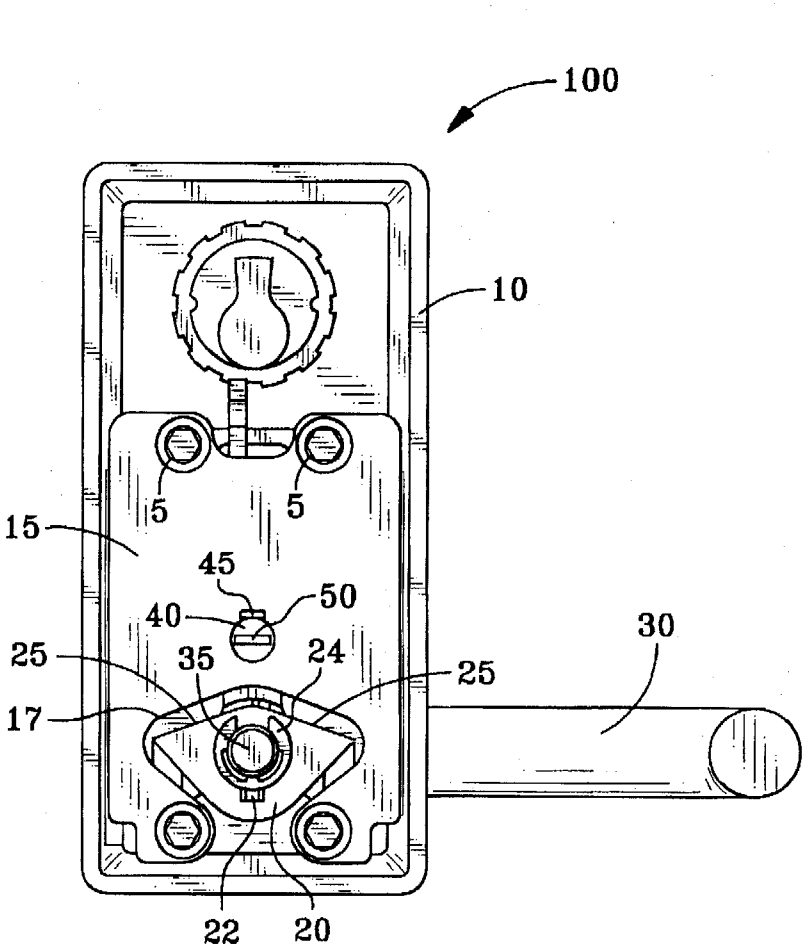
FIG. 2 is a schematic rear elevation view of the door lever assembly shown in FIG. 1.
Figure 4:
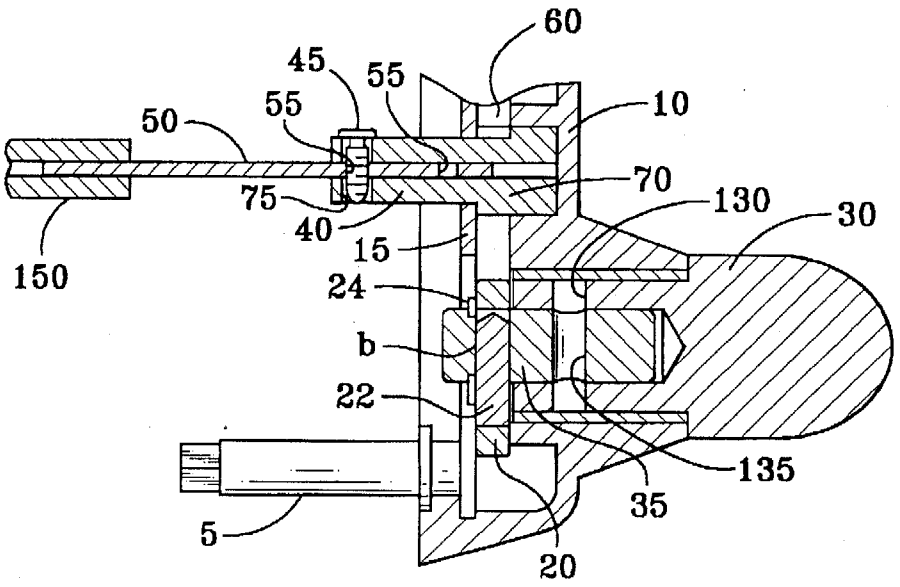
FIG. 4 is a fragmentary sectional view in the direction of the arrows of line "4—4" of FIG. 3.
Figure 3:
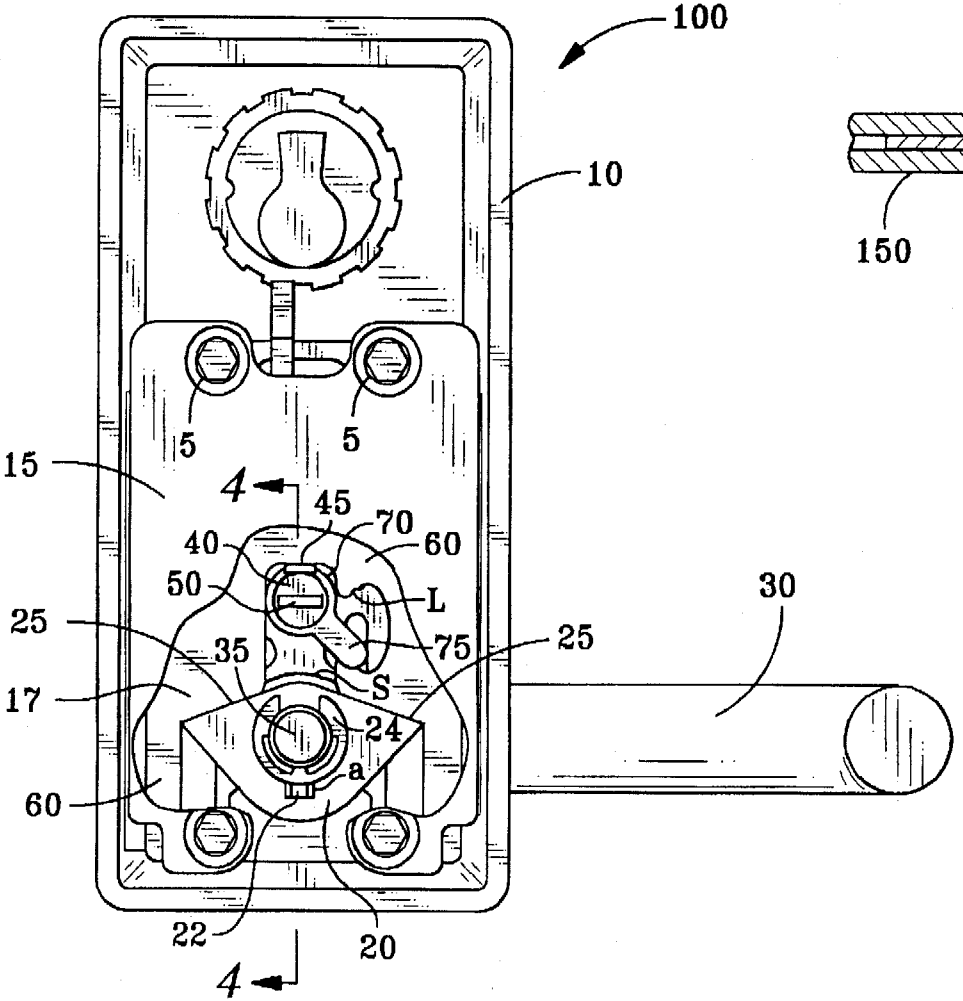
FIG. 3 is a schematic view of the assembly as in FIG. 2, with a portion of the cover plate broken away to show greater detail of the operating features of the invention.

The assembly 100, as seen in FIGS. 2, 3, and 4, has a housing 10 in which are mounted the lever shaft 35, cam 20, slider 60, and input cam 70; all of which, except for cam 20 are mounted behind cover plate 15. The cover plate 15 is secured to housing 10 by studs 5. Lever shaft 35 extends from lever 30, to which it is fixed for rotation thereby using a press fitted pin (not shown) in aligned holes 135 and 130 of the shaft 35 and handle 30, respectively, through housing 10 and protrudes far enough for mounting the cam 20 and its retaining ring 24. A transverse through-drilled bore "b" is provided in lever shaft 35 for driving the cam 20 when it is installed on the shaft. A shear pin 22 of a length L greater than the diameter D of lever shaft 35 (preferred L is equal to approximately 1.5×D) is installed in bore "b" of the lever shaft.

The cam 20 has a bore with a diameter which makes a slip fit on lever shaft 35 and also has (in one embodiment) symmetric opposed lobes 25 to coact with the slider 60 for either left or right handing. (Note that, if the lever is designed to rotate in only one direction, the cam 20 requires only one lobe.) It has a recess or slot "a" extending radially from the bore and approximately four degrees (4°) offset with respect to the opposed lobes 25 of cam 20. This slot does not extend completely through cam 20 and, when the cam 20 is leveled, the offset slot aligns with the transverse bore "b" through lever shaft 35 and receives the protruding portion of shear pin 22. Thus, when shear pin 22 is installed in bore "b" of lever shaft 35 and cam 20 is slipped onto the shaft, the shear pin 22, which has a slip fit in the bore "b", nests in the slot or recess "a" and is retained in the shaft by the cam. This transmits torque between the lever shaft 35 and cam 20 so that, when the lever 30 is moved, the cam responds; and, conversely, when the cam 20 is moved by the return mechanism (not shown), the shaft 35 also turns and returns the lever 30 to its parked position. At the same time, the shear pin 22 provides protection for the door lever assembly 100 against vandalism and over-torquing in general. If excessive torque is applied, the shear pin fails and the lever turns freely, thereby avoiding damage to other parts of the assembly. Because the cam and shear pin have slip fits with the lever shaft; they are easily removed for replacement of the shear pin 22, when necessary, or for reversing the cam 20 to change handing of the lever 30.

The cam 20 is secured on shaft 35 by retaining ring 24. Thus, the retaining ring 24, retains cam 20, which has a slip fit on shaft 35, on the shaft; and the cam 20 retains shear pin 22, which has a slip fit in transverse bore "b" and protrudes into the slot "a" of the cam 20, to ensure co-rotation of shaft 35 and cam 20 under normal operating conditions.

The approximately 4° offset requires the reversal of the cam 22 for handing changes because it imparts a slight upward bias on the lever handle 30 to compensate for tolerance accumulation during assembly and for wear during service.

FIG. 3, where the cover plate 15 has been cut away, and FIG. 4 illustrate further details of the invention, in which, cam 20 is symmetrical in all respects except for the offset of slot "a". Lobes 25 are identical and have the same driving effect on the slider 60 regardless of the direction in which the lever 30 and lever shaft 35 rotate. When the lever 30 is rotated, shaft 35 and cam 20 also rotate. Cam lobes 25 push against slider 60 to move the slider and to thereby move the lever arm 75 of cam 70 which is positioned in the lateral branch "L" of the branched slot "S" of the slider. This rotary motion is transferred by input cam shaft 40 to tailpiece 50 and thence to the door latch spindle 150.

Pin 45 retains tailpiece 50 in shaft 40 of cam 70 by extending through a transverse bore 75 in the shaft 40, the bore 75 being aligned with one of a plurality of (preferably two) holes 55 (not numbered) in the tailpiece 50. The holes 55 are spaced at indexed intervals corresponding to tailpiece extensions required to engage the latch spindle 150 for the most common door 1 thicknesses, so that when pin 45 is inserted, it locks the tailpiece in registry at the appropriate indexed hole. This allows field adjustment of the effective length of the tailpiece 50 by merely removing retainer pin 45, sliding the tailpiece into or out of input cam shaft 40 to align a selected hole, and replacing pin 45. This can be accomplished without using tools and without the necessity of breaking or cutting the tailpiece.

To reverse lever handing, retaining ring 24 is removed from lever shaft 35; a screwdriver or pry tool is inserted into a lower corner of the housing 10; and the slider 60 is raised sufficiently to remove the weight from lobes 25 of cam 20. Cam 20 can then be slipped off of shaft 35, reversed, and replaced. (The shear pin can be removed and replaced by the same steps.) In both cases, the cam 20 is oriented properly for the handing desired and is slipped onto shaft 35 so that the portion of shear pin 22 which projects out of the shaft is nested in and retained by the slot "a" of cam 20. Retaining ring 24 is then snapped onto the lever shaft 35 to complete the installation, and the screwdriver or pry bar is removed to release the slider 60 to return it to rest against the lobes 25 of cam 20.

This invention permits lever handing changes, shear pin replacement, and tailpiece length adjustment for lever operated door locks using only simple tools and by only minimal disassembly of the lever handle assembly. Because of the easy field adjustment; locks can be supplied with lever handle assemblies of a single handing and, if necessary, adjusted in the field. Another advantageous feature of this invention is the single tailpiece for all common door thicknesses which adapts without cutting or breaking to simplify installation.

What is claimed is:

1. A door lever handle assembly having the capability for reversing handing during installation, comprising:

a housing having a face with a bore for receiving a rotatable lever shaft;

an input cam rotatably mounted in said housing, said input cam having a shaft, with means for transmitting rotary motion to a latch spindle, and a lever arm for rotatably driving said cam and shaft;

a slider surrounding the shaft and the lever arm of said input cam and having a branched slot for permitting said slider to move relative to said shaft while driving said lever arm; and means for removably mounting a cam on said lever shaft to be driven thereby against a surface of said slider, said cam moving the slider, when the lever shaft is rotated, to drive the lever arm of said input cam and to thereby rotate the shaft of said input cam.

2. The door lever assembly of claim 1, wherein the means for removably mounting a cam on said lever shaft comprises a bore in said cam, said bore having a slip fit on said shaft, and means for causing said cam to rotate with said lever shaft and vice versa.

3. The door lever assembly of claim 1, further comprising:

a shear pin for installation in a transverse bore of said lever shaft, one end of said shear pin protruding from said shaft and nested in a slot of said cam, when said cam is installed on said lever shaft, to drive said cam when said lever shaft is rotated.

4. The door lever assembly of claim 2, further comprising:

means for retaining said cam on said lever shaft.

5. The door lever assembly of claim 3, further comprising:

means for retaining said cam on said lever shaft.

6. The door lever assembly of claim 1, wherein the means, of said input cam, for transmitting rotary motion to said latch spindle comprises a tailpiece mounted to the shaft of said input cam and extending therefrom to engage said latch spindle.

7. In a door lever assembly, for use with a panic exit device, said assembly having a lever with a lever shaft for imparting rotational motion to a door latch spindle, the improvement in combination with said door lever assembly, comprising:

means comprising an input cam for receiving rotary motion imposed on it by operation of said lever and for transmitting such motion to said door latch spindle, said input cam having a shaft with a transverse bore; and a tailpiece adapted for telescopic engagement with the shaft of said input cam, having a length sufficient for providing rotational connection between the shaft of said input cam and said door latch spindle in doors of differing thickness, and having length-indexed means for drivably connecting with said shaft of said input cam.

8. The improvement of claim 7, wherein the means, of said tailpiece, for drivably connecting with said shaft of said input cam comprises a plurality of transverse bores in said tailpiece, said bores being indexably spaced to conform to standard door thicknesses.

9. The improvement of claim 8, further comprising:

a retaining pin which, when the transverse bores of said shaft of said input cam and said tailpiece are aligned and said retaining pin is inserted therein, establishes the length of said tailpiece extending from said shaft toward said latch spindle and also drivably connects said shaft and said tailpiece.

10. A door lever handle assembly having the capability for reversing handing prior to installation, comprising:

a housing having a face with a bore for receiving a lever shaft;

an input cam rotatably mounted in said housing, said input cam having a lever arm and a shaft for transmitting rotary motion to a latch spindle;

a slider plate surrounding the shaft and the lever arm of said input cam and having a branched slot for permitting said slider to slide relative to said shaft, driving said lever arm, and causing said input cam to rotate; and a cam mounted on said lever shaft for rotation therewith, said cam driving said slider plate to drive said lever arm and to thereby rotate the shaft of said input cam.

11. The door lever assembly of claim 10, further comprising:

a tailpiece means for extending between the shaft of said input cam and said latch spindle and for causing said latch spindle to co-rotate with said shaft of said input cam.

12. The door lever assembly of claim 11, wherein said tailpiece means has transverse bores for indexibly engaging a transverse bore of said shaft of said input cam to provide latch spindle drive in doors of differing thicknesses.

* * * * *